United States Patent [19]

Niemann et al.

[11] 4,272,966

[45] Jun. 16, 1981

[54] COOLING SYSTEM UTILIZING OUTSIDE AIR

[76] Inventors: Eugene E. Niemann; Kelly E. Niemann, both of 100 W. 4th St., Appleton City, Mo. 64624

[21] Appl. No.: 86,280

[22] Filed: Oct. 19, 1979

[51] Int. Cl.[3] ..... F25D 17/00

[52] U.S. Cl. ..... 62/180; 62/332; 62/409; 62/412; 165/16; 236/49

[58] Field of Search ..... 62/332, 409, 412, 180; 165/16; 236/49

[56] References Cited

U.S. PATENT DOCUMENTS

| | | | |
|---|---|---|---|
| 3,720,258 | 3/1973 | Chandler | 165/16 |
| 3,979,922 | 9/1976 | Shavit | 165/16 |
| 3,982,583 | 9/1976 | Shavit | 165/16 |
| 4,023,947 | 5/1977 | Ferry | 62/412 |
| 4,147,038 | 4/1979 | Hoebing et al. | 62/412 |
| 4,175,401 | 11/1979 | McManus | 62/412 |
| 4,178,770 | 12/1979 | Fox | 62/412 |

*Primary Examiner*—Ronald C. Capossela

*Attorney, Agent, or Firm*—Lowe, Kokjer, Kircher, Wharton & Bowman

[57] ABSTRACT

Equipment for cooling a plurality of containers, each of said containers characterized by a refrigeration unit in association therewith, said equipment being responsive to the temperature of the environment where said units are located and comprising:

duct means for collecting cooled air from said containers and returning it to said containers;

blower means disposed in said duct means for recycling the collected air to said containers;

auxiliary cooling means disposed in said duct means downstream from said blower means;

temperature responsive means for sensing the temperature of the environment; and circuit means coupled with said temperature responsive means for deactivating said refrigeration units in response to a predetermined temperature drop and activating said auxiliary cooling means and said blower means.

8 Claims, 2 Drawing Figures

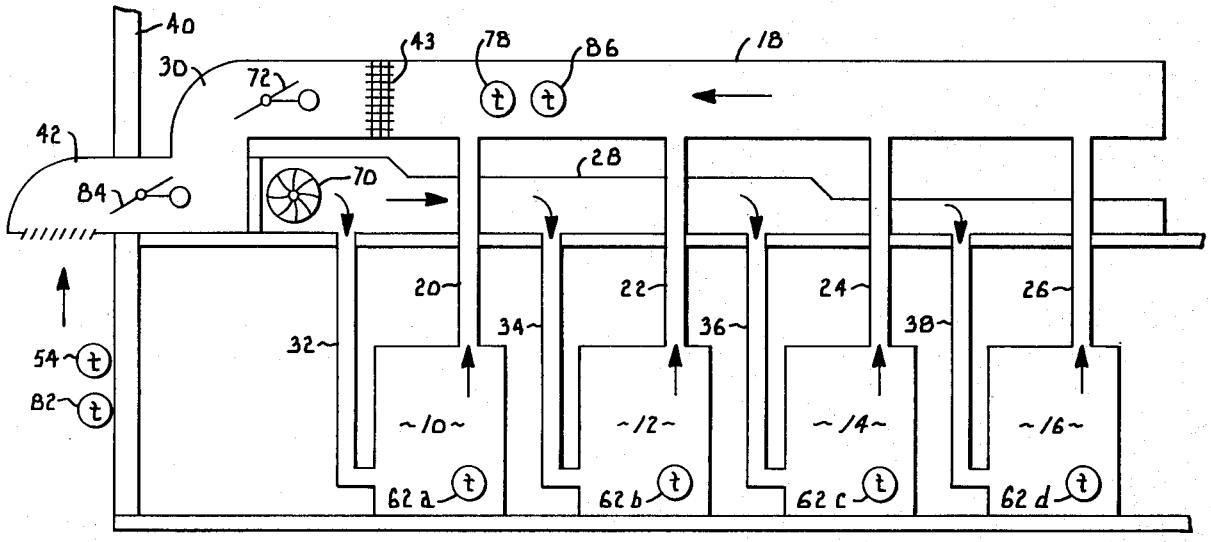
Fig. 1.
Fig. 2.
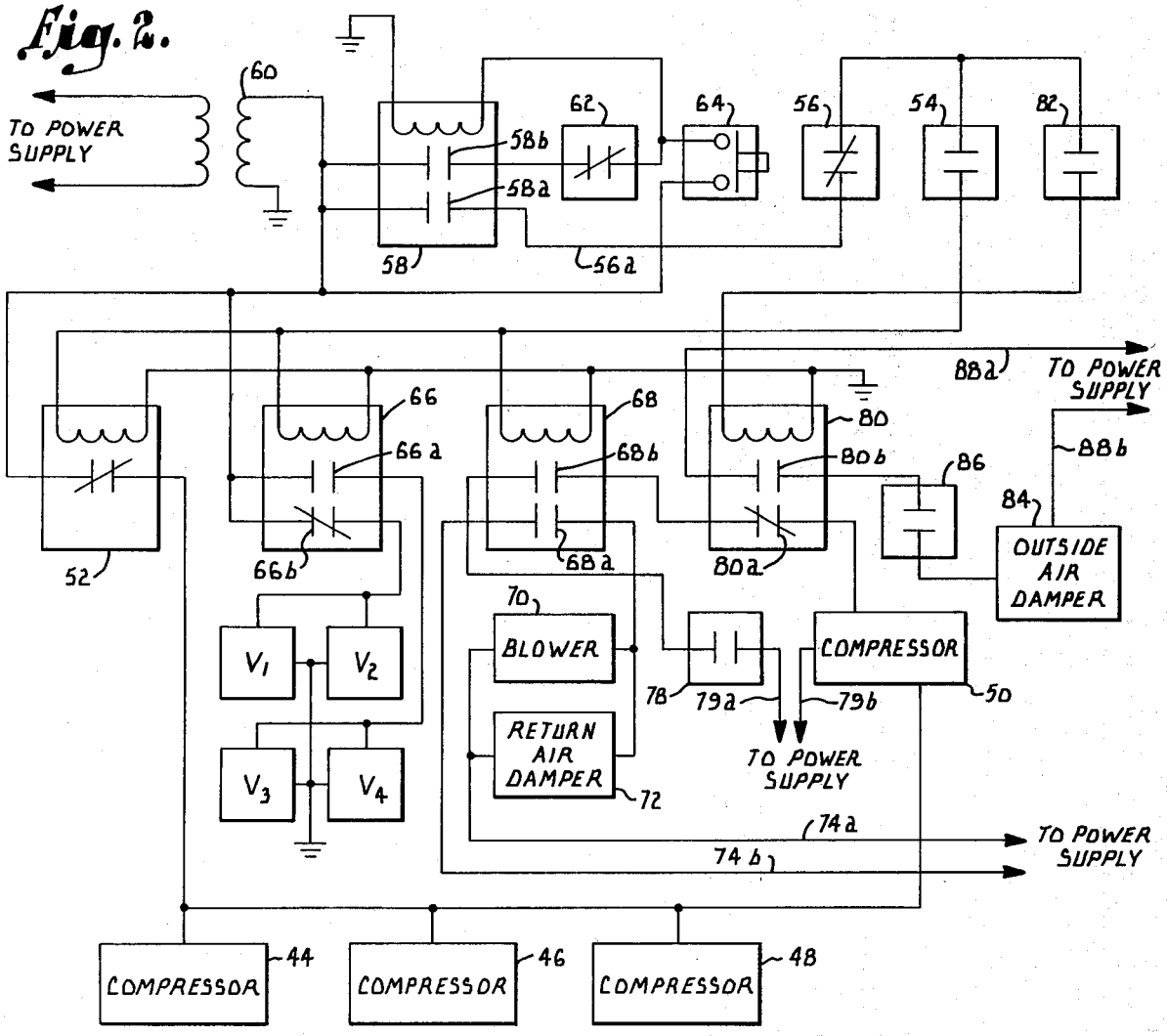

COOLING SYSTEM UTILIZING OUTSIDE AIR

BACKGROUND AND SUMMARY OF THE INVENTION

This invention relates generally to cooling systems and, more particularly, to a system of cooling a plurality of containers such as food coolers or freezers.

It is known in the art to utilize cool outside air to supplement or replace refrigerated air provided to cases and freezers inside of buildings. Examples of the prior art techniques for accomplishing this are found in U.S. Pats. Nos. 1,053,443 issued Feb. 18, 1913; 2,067,9559 issued Jan. 19, 1937; 4,023,947 issued May 17, 1977; and 4,147,038 issued Apr. 3, 1979.

All of the prior art devices, to the knowledge of the present applicants, operate on the principal of sensing the ambient temperature and when the ambient air falls below a predetermined temperature value, an auxiliary cooling unit drawing cold outside air operates to maintain the temperature inside the refrigerated container at a temperature below the temperature setting for the thermostatically controlled primary refrigeration unit. In this manner, the primary unit remains inactive during an interval of time when outside temperature is below the predetermined temperature value.

The primary disadvantage of the prior art systems is that they offer no "transition phase" between cooling with the primary refrigeration units and cooling with outside air. This limits the use of the systems to environments where outside air temperature is very cold for long periods of time. These systems also require that the temperature at which outside air is utilized be several degrees below the desired temperature of the area being cooled so as not to experience excessive shifting between the primary and auxiliary cooling systems which would detract from the operating efficiencies.

It is, therefore, a primary object of the present invention to provide a cooling system for a plurality of cooling units which increases the energy efficiency required for cooling by utilizing a single mechanical cooling means to provide cool air for all of the units when the environmental temperature drops below a predetemined value which value is above the temperature at which outside air may be efficiently utilized.

It is also an objective of the present invention to provide an improved cooling system for multiple cooling units located inside of a building which provides for an auxiliary cooling unit to cool all containers when a first temperature drop is experienced and then utilize outside air for cooling of the units when a second temperature drop is experienced.

It is also an important aim of the invention to provide auxiliary cooling means for a number of refrigerated containers, which auxiliary cooling means is operated in response to an environmental temperature drop and wherein the auxiliary unit may have one or more components in common with one of the primary refrigeration units.

A further objective of the invention is to provide a cooling system as described above which includes a failsafe circuit so that in the event of an unexpected temperature rise the conventional refrigeration units will be reactivated.

Other objects of the invention will be made clear of become apparent from the following description and claims when read in light of the accompanying drawing wherein:

FIG. 1 is a schematic view of the cooling system of the present invention as it is utilized in conjunction with multiple containers; and FIG. 2 is an electrical schematic of the control circuitry for operating the equipment which is utilized to provide cooling to the containers.

Referring first of all to FIG. 1, a plurality of food containers are designated by the numbers 10 through 16. Containers 10 through 16 represent any type of refrigerated enclosure including partially enclosed fresh food cases, frozen food compartments and walk-in freezers. The present invention is applicable to all of the foregoing as well as any other type of container which is cooled by mechanical refrigeration. A return air duct has a first leg 18 with a plurality of feeder ducts 20–26 in communication therewith for returning "unused" cool air from containers 12 through 16. Ducts 20–26 will normally have their intakes located adjacent the blowers (not shown) of the refrigeration units for the respective containers. The duct intakes are positioned so that the air which is blown over the cooling coils but is "spilled over" rather than reaching the inside of the container is collected.

A second leg of the return air duct is designated by the numeral 28 and is in communication with leg 18 through an elbow 30. A plurality of connecting ducts 32–38 communicate with leg 28 and the respective containers 10–16. All of the duct work along with containers 10, 12, 14 and 16 are normally enclosed within a building designated by the numeral 40. An outside air duct 42 communicates with leg 28 of the return air duct and has its inlet opening outside of building 40. An auxiliary cooling coil is designated by the numeral 43 and is also disposed in leg 18 of the return air duct downstream from both the blower 70 and damper 72.

Referring now to the electrical schematic of FIG. 2, each container 10–16 is characterized by a refrigeration unit operably associated therewith. Each refrigeration unit includes a compressor 44, 46, 48 or 50 for compressing and cooling refrigerant circulated through a cooling coil (not shown). Each of the compressors is of a conventional nature and will be well known to those skilled in the art. It is to be understood that the designation "compressor" in the drawing in each instance is intended to include the actual compressor unit and the associated circuitry which includes a standard operating relay and a time delay relay in series therewith so that all of the compressors will not come on line simultaneously even though they receive a common signal.

A compressor control relay 52 having normally closed contacts is connected with the control circuitry for each of compressors 44–50. Relay 52 is also connected with a first thermostat switch 54 having normally open contacts. Switch 54 is in turn connected in series with a normally closed timer 56. Power is provided to the aforedescribed circuit through a line **56*a* passing through a safety lockout relay 58 which is connected with a step down transformer 60. Transformer 60** is connected with a conventional power supply providing either 110 or 220 volts.

Lockout relay 58 has two sets of contacts both of which are normally open. The first set is designated **58*a* and completes the circuit for line 56*a* above described. The second set of contacts is designated 58*b* and is connected with a normally closed thermostat switch 62. Thermostat 62 is in turn connected with a spring biased, manually operable, normally open reset switch 64 which is used to energize relay 58 and thereby activate the system. Thermostat 62 is provided with temperature sensors 62***a*, 62*b*, 62*c* and 62*d* each located in containers 10–16, respectively. Each of the sensors is independently connected with the thermostat switch.

Closing of thermostat 54 also energizes control relays 66 and 68 connected therewith. Relay 66 has a set of normally open contacts 66*a* and a set of normally closed contacts 66*b*. Before the relay is energized, power will be supplied to solenoid valves V1 and V2 through normally closed contacts 66*b*. Energization of the relay will terminate power to valves V1 and V2 and will provide power to solenoid valves V3 and V4.

Relay 68 is provided with two sets of normally open contacts 68*a* and 68*b* which are closed upon energization of the relay. Contacts 68*a* connected with a blower fan 70 which is disposed in leg 28 of the return air duct. Also included in the circuit with contacts 68*a* and blower 70 is a solenoid operated return air damper 72. Return air damper 72 is located in the upper leg 18 of the return air duct downstream from blower 70. It is to be noted that blower 70 and air damper 72 are both connected with supply lines 74*a* and 74*b* which are connected to a power supply of either 110 or 220 volts for operating the motors of the blower and the damper.

The second set of contacts 68*b* is connected with compressor 50 through a thermostat switch 78 and independent power supply lines 79*a* and 79*b*. Lines 79*a* and 79*b* will be connected to a standard 220 volt power source. The circuit is completed through normally closed contacts 80*a* of another control relay 80. Thermostat 78 is disposed in leg 18 of return air duct downstream from blower 70.

A second outside air thermostat switch 82 is disposed in the vicinity of first outside thermostat 54 and is in the same circuit with relay 80. When relay 80 is energized and its second set of normally open contacts 80*b* are closed, thermostat 82 completes a circuit with a solenoid operated outside air damper 84 through a second induct thermostat switch 86. Thermostat 86 is also disposed in the return air duct so as to sense the temperature of air from containers 10–16. Lines 88*a* and 88*b* of the circuit which includes the damper 84 and thermostat 86 are connected with a power supply of 110 or 220 volts for operating the damper motor.

In utilizing the present invention in conjunction with a conventional refrigeration system, three operating modes are experienced. First of all, to activate the system, reset switch 64 is manually closed thereby energizing relay 58 and closing contacts 58*a* and 58*b*. This places the control circuit in standby condition to receive signals from thermostats 54 and 82. So long as the outside ambient temperature as sensed by thermostats 54 and 82 remains relatively high, all of the control circuits will remain open. During this period, containers 10–16 will be cooled by the individual refrigeration units in association therewith as represented by compressors 44–50. To this end, it is to be noted that compressor 50 receives power from the closed circuit through relay 52 notwithstanding the open circuit from the auxiliary power supply through lines 79*a* and 79*b*. During this mode of operation, dampers 72 and 84 will both remain in their normally closed positions blocking the flow of air through ducts 18 and 42 and blower 70 will not be running.

As the outside air temperature falls, thermostat 54 will sense a predetermined temperature drop thereby closing the circuit to control relays 52, 66 and 68. This effects operation in the second mode of the system. Energization of relay 52 immediately deactivates the individual compressors 44–48 and breaks the primary power source to compressor 50. Simultaneously, relay 66 energizes solenoid valves V3 and V4 while de-energizing valves V1 and V2. This results in transfer of refrigerant from the primary cooling coil (not shown) associated with compressor 50 (or any other one of the other compressors) to auxiliary cooling coil 43 operably associated with compressor 76. Also simultaneously with compressors 44–48 being taken off line, relay 68 causes return air damper 72 to open, blower 70 to commence operating and compressor 50 to continue operating via power from the secondary source represented by lines 79*a* and 79*b*. Thus, compressor 50 will now circulate refrigerant through secondary cooling coil 43. In this manner, the single compressor provides cooling for all of containers 10–16 so long as the outside air temperature sensed by thermostat 54 remains below the predetermined value. By recirculating partially cooled and unused air from each of the containers 10–16, the load on compressor 50 is decreased and the single compressor is operated much more efficiently than the individual compressors associated with each of the containers could be if they were all operating. The extent of operation of compressor 50 once it is on line is controlled by in-duct thermostat 78. Manifestly, thermostat 78 will be set to close at approximately the same temperature as thermostat 54 closes but will open after a predetermined additional drop in temperature.

The third mode of operation occurs when a second predetermined temperature drop of the outside air is sensed by thermostat 82. The result is that control relay 80 is energized thereby opening the secondary circuit to compressor 50 and taking this unit off line. Simultaneously, the circuit to control damper 84 is closed thereby opening this damper and allowing outside air to enter leg 28 of the return air duct. Since blower 70 and return air damper 72 are still on line, air will be circulated by the blower and returned via ducts 20–26 and the two legs 18 and 28 comprising the return air duct. The quantity of outside air entering the ducts is determined by the relative opening and closing of damper 84 which is in turn dictated by in-duct thermostat 86. That is, once thermostat 82 closes to activate damper 84, continued operation of the damper is under the control of thermostat 86. So long as the outside air temperature remains below the second predetermined value sensed by thermostat 82, all of compressors 44–50 will remain off line and cooling will be provided solely by the outside air.

Whenever compressors 44–50 remain off line for an extended period of time, there is a danger of the compressors flooding with refrigerant particularly when the ambient temperature is abnormally low. To prevent this, timer 56 is designed to periodically open thereby breaking the control circuit through both thermostats 54 and 82. This will de-energize control relay 52 and bring compressors 44–50 on line for a few minutes to circulate refrigerant.

The temperature inside of each of the containers 10–16 is continually monitored by temperature sensors 62*a*, 62*b*, 62*c* and 62*d* each of which is independently connected with thermostat 62. Thus, in the event of a failure anywhere in the system resulting in a temperature rise in any one container, thermostat 62 will open thereby breaking the circuit to relay 58 and opening the circuit to control relays 52, 66, 68 and 80. This, of course, causes the compressors 44–50 to all come back on line while the auxiliary system is deactivated.

By combining the benefits of recycling partially cooled air with utilization of auxiliary cooling coil 43, a much more efficient cooling system is provided. This system is in turn rendered even more efficient by use of supplemental outside air when the temperature drop is sufficient to warrent this. By providing for a transition stage between operating completely with the individual refrigeration units and utilizing outside air completely, the overall efficiency achieved is much greater than those systems where only outside air is used to augment the individual refrigeration units.

We claim:

1. Equipment for cooling a plurality of containers inside of a building, each of said containers characterized by a refrigeration unit in association therewith, said equipment being responsive to ambient air temperature and utilizing said outside air for cooling, said equipment comprising:

first duct means for collecting cooled air from said containers and returning it to said containers;

blower means disposed in said duct means for recycling the collected air to said containers;

auxiliary cooling means disposed in said duct means downstream from said blower mean;

first temperature responsive means for sensing the temperature of said ambient air;

first circuit means coupled with said first temperature responsive means for deactivating said refrigeration units in response to a first temperature drop and activating said auxiliary cooling means and said blower means;

second duct means for receiving outside air, said second duct means being in communication with said first duct means;

primary closure means for opening and closing said second duct means to the passage of air therethrough;

second temperature responsive means for sensing the temperature of the ambient air; and second circuit means coupled with said second temperature responsive means for operating said primary closure means in response to a second temperature drop whereby said closure means is opened and outside air is brought into said second duct.

2. The invention of claim 1, wherein said second circuit means includes means for deactivating said auxiliary cooling means in response to said second temperature drop.

3. The invention of claim 2, wherein is included secondary closure means for opening and closing said first duct means to the passage of air therethrough, said first circuit means including means for operating said second closure means to open the latter in response to said first temperature drop.

4. The invention of claim 3, wherein is included third temperature responsive means for sensing the temperature of air from said containers and third circuit means coupled with said third temperature responsive means for operating said auxiliary cooling means in response to temperature changes sensed by said third temperature responsive means.

5. The invention of claim 4, wherein is included fourth temperature responsive means for sensing the temperature of air from said containers and fourth circuit means coupled with said fourth temperature responsive means for operating said primary closure means in response to temperature changes sensed by said fourth temperature responsive means.

6. The invention of claim 1, wherein said first circuit means includes timer means for periodically reactivating said refrigeration units and deactivating said auxiliary cooling means.

7. The invention of claim 1, wherein each of said refrigeration units includes a compressor and wherein said auxiliary cooling means comprises a cooling coil, said coil being operably associated with one of the compressors.

8. The invention of claim 1, wherein is included fifth circuit means coupled with said first circuit means and including fifth temperature responsive means for sensing the temperature in at least one of said containers, said fifth circuit means reactivating said refrigeration units in response to a predetermined temperature rise in said one container.

* * * * *

UNITED STATES PATENT OFFICE

CERTIFICATE OF CORRECTION

PATENT NO. : 4,272,966

DATED : June 16, 1981

INVENTOR(S) : Eugene E. Niemann; Kelly E. Niemann

It is certified that error appears in the above-identified patent and that said Letters Patent are hereby corrected as shown below:

Page 1, column 1, line 3,
After the title, insert the following:

-- The Government of the United States of America has rights in this invention pursuant to grant no. DE-FG47-80R70 1135. --

Signed and Sealed this

*Twenty-seventh* Day of *July 1982*

[SEAL]

*Attest:*

GERALD J. MOSSINGHOFF

*Attesting Officer*

*Commissioner of Patents and Trademarks*